US006928168B2

(12) United States Patent
Kirkeby

(10) Patent No.: US 6,928,168 B2
(45) Date of Patent: Aug. 9, 2005

(54) TRANSPARENT STEREO WIDENING ALGORITHM FOR LOUDSPEAKERS

(75) Inventor: Ole Kirkeby, Espoo (FI)

(73) Assignee: Nokia Corporation, Espoo (FI)

( * ) Notice: Subject to any disclaimer, the term of this patent is extended or adjusted under 35 U.S.C. 154(b) by 841 days.

(21) Appl. No.: 09/766,082

(22) Filed: Jan. 19, 2001

(65) Prior Publication Data

US 2002/0097880 A1 Jul. 25, 2002

(51) Int. Cl.[7] ..... H04R 5/00
(52) U.S. Cl. ..... 381/1; 381/17
(58) Field of Search ..... 381/1, 17, 303

(56) References Cited

U.S. PATENT DOCUMENTS

| | | | | |
|---|---|---|---|---|
| 3,236,949 A | | 2/1966 | Atal et al. | |
| 4,121,059 A | | 10/1978 | Nakabayashi | |
| 4,748,669 A | | 5/1988 | Klayman | |
| 4,975,954 A | | 12/1990 | Cooper et al. | |
| 5,046,097 A | | 9/1991 | Lowe et al. | |
| 5,333,200 A | | 7/1994 | Cooper et al. | |
| 5,412,731 A | | 5/1995 | Desper | |
| 5,420,929 A | | 5/1995 | Geddes et al. | |
| 5,666,425 A | | 9/1997 | Sibbald et al. | |
| 5,671,287 A | * | 9/1997 | Gerzon | 381/17 |
| 5,684,881 A | | 11/1997 | Serikawa et al. | |
| 5,727,066 A | * | 3/1998 | Elliott et al. | 381/1 |
| 5,740,253 A | * | 4/1998 | Takeuchi | 381/1 |
| 5,862,227 A | | 1/1999 | Orduña-Bustamante et al. | |
| 5,917,916 A | | 6/1999 | Sibbald et al. | |
| 6,091,894 A | * | 7/2000 | Fujita et al. | 381/17 |
| 6,243,476 B1 | * | 6/2001 | Gardner | 381/303 |
| 6,307,941 B1 | * | 10/2001 | Tanner et al. | 381/17 |
| 6,633,648 B1 | * | 10/2003 | Bauck | 381/303 |
| 6,668,061 B1 | * | 12/2003 | Abel | 381/1 |

OTHER PUBLICATIONS

P.A. Regalia, S.K. Mitra, and P.P. Vaidyanathan, "The Digital All–Pass Filter: A Versatile Signal Processing Block", Proceedings of the IEEE, vol. 76, No. 1, pp. 19–37, Jan. 1988.

T. Saramäki, Y. Neuro and S.K. Mitra, "Design of Computationally Efficient Interpolated FIR Filters", IEEE Transactions on Circuits and Systems, vol. 35, No. 1, pp. 70–88, Jan. 1988.

S. Holford and P. Agathoklis, "The Use of Model Reduction Techniques for Designing IIR Filters with Linear Phase in the Passband", IEEE Transactions on Signal Processing, vol. 44, No. 10, pp. 2396–2404, Oct. 1996.

Y. Lin and P.P. Vaidyanathan, "An Iterative Approach to the Design of IFIR Matched Filters", 1997 IEEE International Symposium on Circuits and Systems, pp. 2268–2271, Jun. 9–12, 1997.

(Continued)

*Primary Examiner*—Stella Woo
(74) *Attorney, Agent, or Firm*—Cohen, Pontani, Lieberman & Pavane

(57) ABSTRACT

A stereo widening processing algorithm is used to provide a system and method for giving a listener an impression that a stereo audio signal having left and right channels is emanating from a virtual source spaced away from left and right stereo loudspeakers. This algorithm, which works particularly well when the loudspeakers are spaced apart by a distance that is less than optimal, introduces and filters cross-talk from the left channel to the right loudspeaker and cross-talk from the right channel to the left loudspeaker to only introduce cross-talk at frequencies below approximately 2 kHz, and primarily between 500 Hz to 1.5 kHz. The desired stereo widening is thereby achieved without noticeably affecting the sound quality of the stereo audio signal when played on the loudspeakers.

26 Claims, 2 Drawing Sheets

OTHER PUBLICATIONS

W.G. Gardner, *Theory and Implementation* 3–D Audio Using Loudspeakers, pp. 68–78, Kluwer Academic Publishers (1998).

S.L. Gay and J. Benesty (Editors) *Acoustic Signal Processing for Telecommunication* Virtual Sound Using Loudspeakers, pp. 313–317, Kluwer Academic Publishers (2000).

A. Jost and J–M Jost, "Transaural 3–D Audio With User–Controlled Calibration", Cost G–6 Conference on Digital Audio Effects, Verona, Italy, pp. 61–66, Dec. 7–9, 2000.

O. Kirkeby, P.A. Nelson, and H. Hamada, "Virtual Source Imaging Using the Stereo Dipole", pp. 1–8 and Figs. 1–8, presented at the 103$^{rd}$ Convention of the Audio Engineering Society in New York, AES Preprint No. 4574–J10.

Markus Lang, Timo I. Laasko, "Design of Allpass Filters for Phase Approximation and Equalization Using LSEE Error Criterion", Circuits and Systems, 1992. ISCAS '92 Proceedings, 1992 IEEE International Symposium, vol. 5, pp. 2417–2420.

Rajamohanna Hegde, B.A. Shenoi, "Magnitude Approximation of Digital Filters with Specified Degrees of Flatness and Constant Group Delay Characteristics", IEEE Transactions on Circuits and Systems II—Analog and Digital Signal Processing 45:11 (Nov. 1998).

European Office Action dated Jan. 10, 2005.

Search Report dated Jul. 23, 2004 in corresponding European Patent Application No. EP 01 12 5836.

* cited by examiner

TRANSPARENT STEREO WIDENING ALGORITHM FOR LOUDSPEAKERS

BACKGROUND OF THE INVENTION

1. Field of the Invention

This invention relates to spatially extending a sound stage beyond the positions of two loudspeakers for enhanced enjoyment of two-channel stereo recordings.

2. Description of the Related Art

The music that has been recorded over the last four decades is almost exclusively made in the two-channel stereo format which consists of two independent tracks, one for a left channel L and another for a right channel R. The two tracks are intended for playback over two loudspeakers, and they are mixed to provide a desired spatial impression to a listener positioned centrally in front of two loudspeakers that ideally span 60 degrees (i.e. relative to the vantage point of the listener, the loudspeakers are at angles of +/−30 degrees). A limited spatial impression can also be experienced from other listening positions. The two-channel stereo format is also used for the final delivery of many other types of entertainment audio, such as MPEG-2 digital television broadcasts with multiple digital sound channels, digital versatile discs (DVDs), videotapes, CD's, audiocassettes, and video games.

In many situations, it is advantageous to be able to modify the inputs to the two loudspeakers in such a way that the listener perceives the sound stage as extending beyond the positions of the loudspeakers at both sides. This is particularly useful when a listener wants to play back a stereo recording over two loudspeakers that are positioned quite close to each other. The loudspeakers contained in a stereo television, for example, or positioned on either side of a computer monitor usually span significantly less than the recommended 60 degrees. Nevertheless, a widening of the sound stage is generally perceived as a pleasant effect regardless of the position of the loudspeakers, and many stereo widening schemes have been developed for this task over the years.

It is well known that when the polarity of one of the two loudspeakers in a conventional stereo setup is reversed, the sound stage becomes blurred in a way which is generally perceived to be undesirable. Nevertheless, this phenomenon demonstrates that it is possible to achieve a spatial effect simply by feeding the two loudspeakers with two coherent signals that are out of phase. It can be shown that at very low frequencies the signals fed to the two loudspeakers must be almost exactly out of phase in order to make the sound stage extend beyond the loudspeakers [Kirkeby et al., *Virtual Source Imaging using the Stereo Dipole*, the 103$^{rd}$ Convention of the Audio Engineering Society in New York, Sep. 26–29, 1997, AES preprint no. 4574-J10].

A stereo widening processing scheme generally works by introducing cross-talk from the left input to the right loudspeaker, and from the right input to the left loudspeaker. The audio signal transmitted along direct paths from the left input to the left loudspeaker and from the right input to the right loudspeaker are usually also modified before being output from the left and right loudspeakers.

As described in U.S. Pat. Nos. 4,748,669 and 5,412,731, sum-difference processors can be used as a stereo widening processing scheme mainly by boosting a part of the difference signal, L minus R, in order to make the extreme left and right part of the sound stage appear more prominent.

Consequently, sum-difference processors do not provide high spatial fidelity since they tend to weaken the center image considerably. They are very easy to implement, however, since they do not rely on accurate frequency selectivity. Some simple sum-difference processors can even be implemented with analogue electronics without the need for digital signal processing.

Another type of stereo widening processing scheme is an inversion-based implementation, which generally comes in two disguises: cross-talk cancellation networks and virtual source imaging systems. A good cross-talk cancellation system can make a listener hear sound in one ear while there is silence at the other ear whereas a good virtual source imaging system can make a listener hear a sound coming from a position somewhere in space at a certain distance away from the listener. Both types of systems essentially work by reproducing the right sound pressures at the listener's ears, and in order to be able to control the sound pressures at the listener's ears it is necessary to know the effect of the presence of a human listener on the incoming sound waves. U.S. Pat. No. 3,236,949 discloses the inversion-based implementations by designing a simple cross-talk cancellation network based on a free-field model in which there are no appreciable effects on sound propagation from obstacles, boundaries, or reflecting surfaces. Later implementations use sophisticated digital filter design methods that can also compensate for the influence of the listener's head, torso and pinna (outer ear) on the incoming sound waves. See e.g. U.S. Pat. Nos. 4,975,954, 5,666,425, 5,727,066, 5,862,227, 5,917,916.

As an alternative to the rigorous filter design techniques that are usually required for an inversion-based implementation, U.S. Pat. No. 5,046,097 derives a suitable set of filters from experiments and empirical knowledge. This implementation is therefore based on tables whose contents are the result of listening tests.

It is common to all the implementations mentioned above that they process a substantial part of the audio frequency range. U.S. Pat. No. 4,975,954 restricts the processing to affect only frequencies below 10 kHz, Gardner suggests the processing cut-off to be at 6 kHz [W. G. Gardner, 3-*D Audio Using Loudspeakers*, Kluwer Academic Publishers, 1998, pp. 68–78], and it is mentioned that the techniques described in U.S. Pat. No. 5,046,097 still work even if the processing is restricted to affect frequencies between 200 Hz and 7 kHz only. Ward and Elko [S. L. Gay and J. Benesty (Editors), *Acoustic Signal Processing for Telecommunication*, pp. 313–317 of Chapter 14, Kluwer Academic Publishers, 2000] suggests splitting up the processing into four different frequency bands: low (<500 Hz), low-mid (500 Hz<f<1.5 kHz), high-mid (1.5 kHz<f<5 kHz), and high (>5 kHz). Only mid frequencies are processed (500 Hz <f<5 kHz) but it is necessary to use four loudspeakers for the reproduction, two closely spaced (±7 degrees recommended) and two widely spaced (±30 degrees recommended).

The widening of the sound stage usually comes at a price. It is difficult to achieve a convincing spatial effect without introducing spectral coloration (i.e. certain parts of sound spectrum become more emphasized versus other parts of the sound spectrum) of the original recording. Reflections from the acoustic environment, such as the walls and furniture in an ordinary living room, tend to make this undesirable spectral coloration effect even more noticeable. Consequently, a stereo widening processing scheme often degrades the quality of the original recording, particularly at positions away from the "sweet spot" (the optimal listening position for which the stereo widening scheme is designed).

At non-ideal listening positions, which may be only a matter of centimeters away from the sweet spot, the processing provides the listener with little or no spatial effect but the spectral coloration is noticeable in all of these non-ideal listening positions. Ideally though, a listener who is not in the sweet spot should not be able to tell whether the processing is "on" or "off". It would therefore be advantageous to have a transparent stereo widening algorithm for loudspeakers that maximizes the spatial effect for a listener sitting in the sweet spot while preserving the quality of the original recording.

SUMMARY OF THE INVENTION

It is an object of the present invention to provide a system and method of extending the sound stage of two closely spaced loudspeakers without deleteriously affecting the sound quality of the audio signal.

In accordance with a first embodiment of the present invention, an audio system is provided for spatially widening a stereophonic sound stage provided by at least two loudspeakers without introducing substantial spectral coloration effects. The audio system comprises (a) a pair of left and right loudspeakers to provide a stereophonic audio output, the left and right loudspeakers being spaced apart from one another; (b) a left channel audio input for inputting a left channel of an audio signal from an audio source to the left loudspeaker over a first direct signal path; (c) a right channel audio input for inputting a right channel of an audio signal from the audio source to the right loudspeaker over a second direct signal path; (d) a first filter stage along the first direct signal path intermediate the left channel audio input and the left loudspeaker for introducing a delay, which is possibly frequency-dependent, to the left channel of the audio signal before the left channel is output at the left loudspeaker; (e) a second filter stage along the second direct signal path intermediate the right channel audio input and the right loudspeaker for introducing the delay, which is possibly frequency-dependent, to the right channel of the audio signal before the right channel is output at the right loudspeaker; (f) a third filter stage intermediate the left channel audio input and the right loudspeaker along a first indirect signal path for adding a first low frequency cross-talk signal at frequencies below approximately 2 kHz derived from the left channel audio input to the delayed right channel of the audio signal; and (g) a fourth filter stage intermediate the right channel audio input and the left loudspeaker along a second indirect signal path for adding a second low frequency cross-talk signal at frequencies below approximately 2 kHz derived from the right channel audio input to the delayed left channel of the audio signal. The third and fourth filter stages may each comprise an element for introducing a gain whose absolute value is smaller than approximately 1.0, and a filter having a magnitude response that is not greater than the magnitude response of the first and second first stages at a frequency below approximately 2 kHz and that is substantially zero at and above approximately 2 kHz. The third and fourth filter stages may also comprise a second element for introducing a second delay that may be greater than the first delay introduced at the first and second filter stages, where the second delay is desired and is not provided by the filter. In one embodiment, the absolute value of the gain of the third and fourth filter stages is between approximately 0.5 and 1.0, and the second delay is between approximately 0 ms and approximately 0.5 ms at frequencies below approximately 2 kHz.

In accordance with a second embodiment of the invention, a method is provided for processing an audio signal for reproducing the audio signal as stereophonic sound by at least right and left loudspeakers in a manner that gives an impression that at least part of the sound emanates from a virtual location spaced apart from the actual location of the loudspeakers without introducing a substantial spectral coloration effect. The method comprises (a) inputting an audio signal comprising left and right audio channels to an audio system comprising left and right loudspeakers; (b) filtering the left audio channel at a first filter stage intermediate a left audio channel input and the left loudspeaker along a first direct signal path between the left audio channel input and the left loudspeaker to delay the left audio channel; (c) filtering the right audio channel at a second filter stage intermediate a right audio channel input and the right loudspeaker along a second direct signal path between the right audio channel input and the right loudspeaker to delay the right audio channel; (d) filtering the left audio channel at a third filter stage intermediate the left channel audio input and the right loudspeaker to add a first low frequency cross-talk at frequencies below approximately 2 kHz derived from the left channel audio input to the delayed right channel of the audio signal; and (e) filtering the right audio channel at a fourth filter stage intermediate the right channel audio input and the left loudspeaker to add a second low frequency cross-talk at frequencies below approximately 2 kHz derived from the right channel audio input to the delayed left channel of the audio signal. The delayed right audio channel that is added to the first low frequency cross-talk is reproduced at the right loudspeaker, and the delayed left audio channel added to the second low frequency cross-talk is reproduced at the left loudspeaker.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
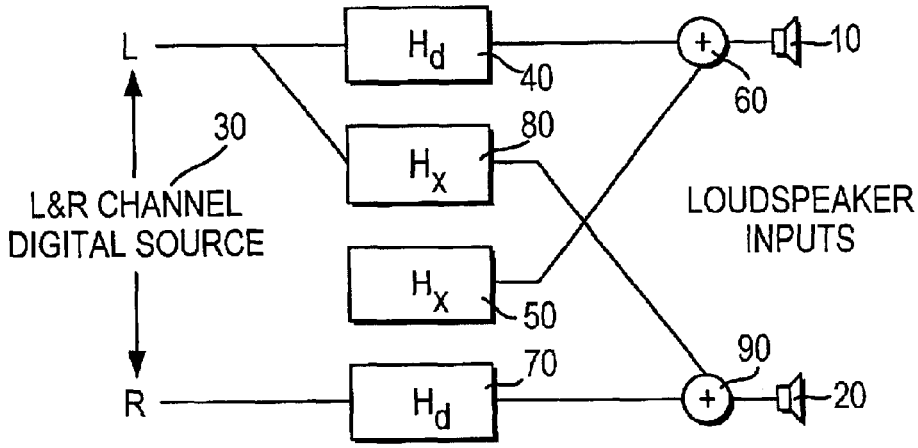
FIG. 1 illustrates the general structure of a stereo widening network, including filters $H_d$ and $H_x$ for loudspeakers according to one embodiment of the invention.

FIG. 1 shows in block form the general structure of a stereo widening network according to the prior art as well as the present invention. The network, which is generally implemented on a digital signal processor (DSP), comprises left and right loudspeakers 10, 20. A digital audio source 30 has separate audio inputs L and R for left and right channels, respectively. (The sound stage can also be widened by placing an additional set of loudspeakers behind a listener.) The audio source 30 is input as a stream that may comprise a live digital audio signal or a digital audio recording stored in any format and on any media. For example, audio source 30 may be an audio signal stored on a DVD, or in the MP3 format. As another example, audio source 30 may be an audio signal that is a soundtrack to a movie, television, or is part of any multimedia program.

A left channel of audio source 30 is input at left channel input L and a right channel of audio source 30 is input at right channel input R. The left channel is filtered by a filter $H_d$ 40, is added at adder 60 to cross-talk from the right channel that is filtered by filter $H_x$ 60, and is output at left loudspeaker 10. Similarly, the right channel is filtered by a filter $H_d$ 70, is added at adder 90 to cross-talk from the left channel that is filtered by filter $H_x$ 80, and is output from right speaker 20. (It should be noted that term "cross-talk" is used herein to refer to the part of the audio signal that is leaked from one input to the 'opposite' output, rather than to refer, as is common, to the acoustic path from a loudspeaker to the 'opposite' ear of a listener.) Generally, rather than implementing them as a single filter, $H_d$ and $H_x$ are each implemented as a filter stage comprising multiple components as is discussed below.

The distinctiveness and advantages of the present invention lies in the derivation and the properties of $H_d$ and $H_x$. The choice of $H_d$ and $H_x$ is motivated by the need for achieving a good spatial effect without degrading the quality of the original audio source material. In the present invention, $H_d$, used for both filters 40, 70, is a filter with a flat magnitude response, thus leaving the magnitude of the signal input thereto unchanged while introducing a group delay (it should be noted that group delays, and delays can vary as a function of frequency). Thus, significantly, $H_d$ permits the respective channel from audio source 30 to pass through on a direct path to that channel's respective loudspeaker without any change in magnitude. $H_x$, used for both filters 50, 80, is a filter whose magnitude response is substantially zero at and above a frequency of approximately 2 kHz, and whose magnitude response is not greater than that of $H_d$ at any frequency below approximately 2 kHz. In addition, a group delay is introduced by filter $H_x$ that is generally greater than the group delay introduced by filter $H_d$.

Figure 2A:
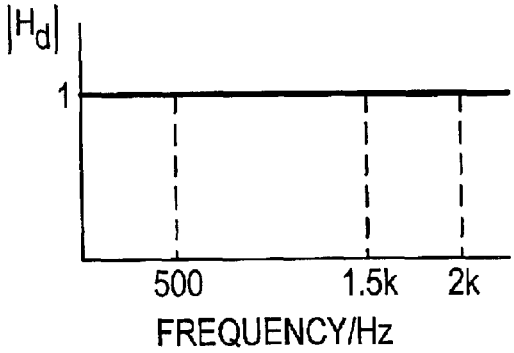
FIG. 2A illustrates an example of appropriate response characteristics of a filter $H_d$ that can be used in a direct path between an audio channel input and its corresponding loudspeaker for each of the right and left channels and corresponding loudspeakers.
Figure 2B:
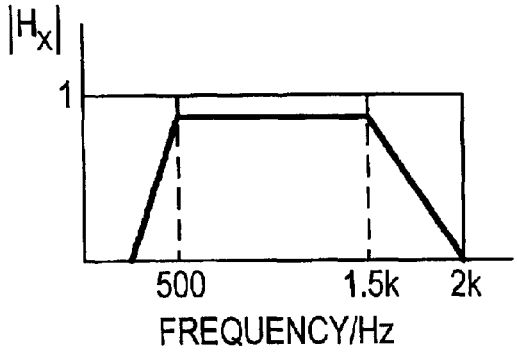
FIG. 2B illustrates an example of appropriate response characteristics of a cross-talk filter $H_x$ used in an embodiment of the invention to introduce a cross-talk signal from a first audio channel to a second audio channel.

FIGS. 2A and 2B show examples of appropriate magnitude responses of $H_d$ and $H_x$, respectively, for the present invention. The magnitude response of $H_x$ is bounded in the vertical direction by the magnitude of $H_d$, and in the horizontal direction by approximately 2 kHz. The magnitude of frequencies above approximately 2 kHz are designed not to be affected by filter $H_x$ because altering the magnitude of these frequencies above approximately 2 kHz creates undesirable spectral coloration.

Figure 3A:
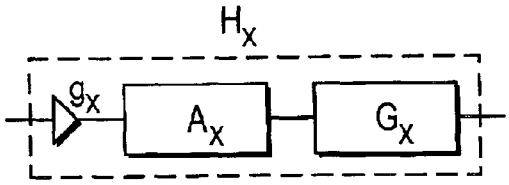
FIG. 3A illustrates the components of one embodiment of a cross-talk filter $H_x$ including a consecutive gain element $g_x$, allpass filter $A_x(z)$, and filter $G_x(z)$.
Figure 3B:
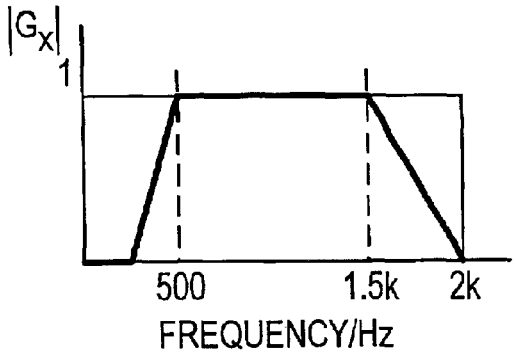
FIG. 3B illustrates a desirable magnitude response characteristics of filter $G_x(z)$ of FIG. 3A.

FIG. 3A illustrates how filter $H_x$ can be separated into three consecutive components which allow separate control over the magnitude and phase responses: (1) a cross-talk path gain $g_x$ whose absolute value is smaller than one, (2) a frequency-independent delay, or frequency-dependent delay introduced for example by an allpass filter $A_x$ [Regalia et al. *The Digital All-Pass Filter: A Versatile Signal Processing Building Block*", Proceeding of the IEEE, 76(1), pp. 19–37, January 1988] (or $A_x(z)$ in the z-transform domain), and (3) a filter $G_x$ ($G_x(z)$ in the z-transform domain) whose maximum magnitude response is one at frequencies below 2 kHz, and is substantially zero at frequencies at and above 2 kHz. FIG. 3B shows an example of the magnitude response of filter $G_x$. Filter $A_x$ is an unnecessary element where filter $G_x$ can provide the desirable delay otherwise provided by filter $A_x$ (e.g. $G_x$ is an FIR filter as described below.)

In practice, it has been found that the filter $H_x$ obtained from the following combination of $g_x$, $A_x(z)$ and $G_x(z)$ gives very good results (i.e. the desired stereo widening with minimal spectral coloration): $g_x \approx -0.8$, $A_x(z)$ is a frequency-independent delay of about 0.2 ms (which results in a delay of about 10 samples relative to the delay introduced by $H_d$ at a sampling frequency of about 48 kHz), and $G_x(z)$ is a bandpass filter that blocks very low frequencies (below approximately 250 Hz) as well as frequencies above approximately 2 kHz. The highpass-characteristic of $G_x(z)$ wherein frequencies below approximately 250 Hz are blocked prevents very low frequencies in one channel of the audio signal from being canceled out by the out-of-phase cross-talk that is added from the other channel. (The left and right channels are 180 degrees out of phase at 0 Hz and slightly less out of phase at low frequencies.) Preventing the loss of low frequencies between approximately 0 and approximately 250 Hz ensures that a natural balance is maintained between low and high frequencies. However, the bandpass characteristic of $G_x(z)$ might not always be required. If the loudspeakers used for the reproduction are very poor, for example, and they are not capable of emitting any significant sound at low frequencies anyway, then there is no need to process this frequency range at all, and in that case $G_x(z)$ could be a simple lowpass filter, instead of the filter with a magnitude response shown in FIG. 3B.

When the absolute value of $g_x$ is smaller than approximately 0.5, the spatial effect of the processing is so subtle that in most situations it will not be beneficial to the listener. When the delay introduced by $A_x(z)$ is greater than approximately 0.5 ms (which results in a delay of approximately 24 samples relative to the delay introduced by $H_d$ at a sampling frequency of approximately 48 kHz), the spatial effect of the processing becomes somewhat unnatural sounding to the human ear (sometimes called "phasiness") and is uncomfortable to listen to, whereas short delays, or even no delay, still has an overall positive effect on the perceived sound. The absolute value of $g_x$ should therefore be between approximately 0.5 and 1.0, and the group delay function of $A_x(z)$ relative to the delay introduced by $H_d$ must be between approximately 0 ms and approximately 0.5 ms at frequencies below about 2 kHz. The value of the group delay function of $A_x(z)$ above approximately 2 kHz is irrelevant since those frequencies are blocked by $G_x(z)$ anyway.

Figure 4:
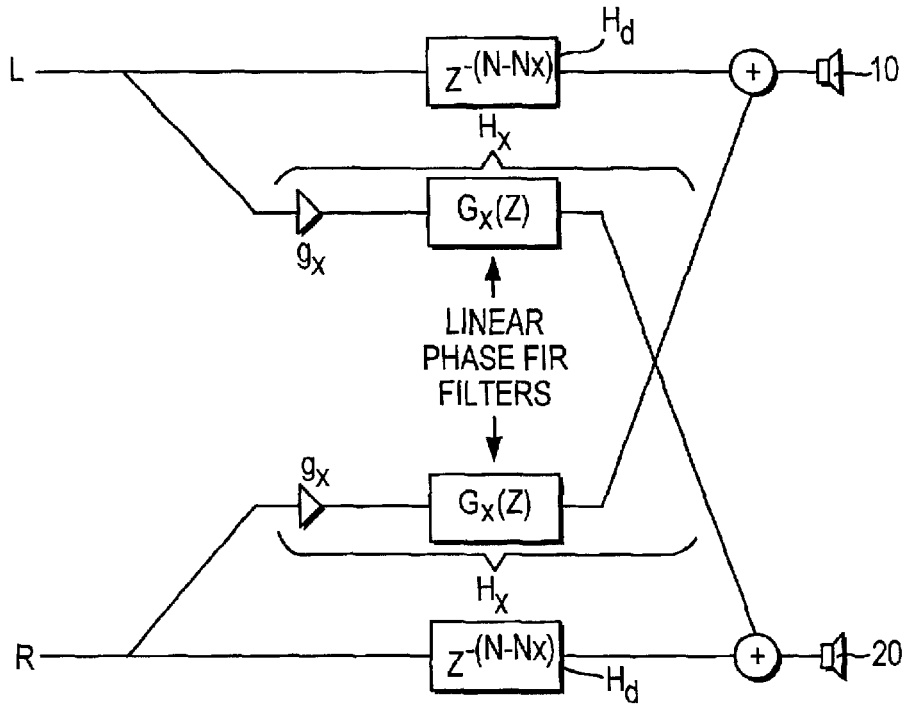
FIG. 4 illustrates an implementation of the stereo widening network according to one embodiment of the invention using linear phase finite impulse response (FIR) filters.

If the sampling frequency is relatively low, the stereo widening algorithm may be conveniently implemented by realizing the cross-talk filters $H_x$ as a gain $g_x$ followed by a linear phase finite impulse response (FIR) filter which is used for $G_x(z)$, and by realizing the direct-path filters $H_d$ as the delay of $z^{-(N-Nx)}$, as shown in FIG. 4. N is the group delay of the linear phase FIR filter, which is of the order of 100 at 48 kHz, and scales up and down linearly with the sampling frequency. Thus, for example, N is of the order of 25 at 12 kHz. (No separate group delay source such as $A_x$ is necessary in this implementation because the delay is added by the FIR filters.) Since the group delay introduced by the linear phase filters are constant as a function of frequency, it is sufficient to insert a delay line in the direct path in order to match the delay of the cross-talk path up to a desired amount of delay, thereby enabling the provision of a controllable amount additional delay in the cross-talk path, relative any delay in the direct path. For example, if the group delay in the cross-talk path is 23 samples at a sampling frequency of approximately 12 kHz, then inserting a delay of about 20 samples in the direct path with filter $H_d$ ensures that the cross-talk path is delayed by about 3 samples, which corresponds to approximately 0.25 ms, relative to the direct path. A fractional delay can be used to match the delays with sufficient accuracy if necessary.

An audio signal having a bandwidth greater than approximately 2 kHz, including a signal whose sampling frequency is relatively low (e.g. approximately 8 kHz—approximately 12 kHz) or relatively high (e.g. approximately 32 kHz—approximately 48 kHz), may be processed by the stereo widening algorithm of the present invention. However, processing at a low sampling frequency does not necessarily mean that the stereo widening algorithm is being used for a lo-fi (low fidelity) application. As an example, where the algorithm is used for processing signals at a low sampling frequency for a hi-fi (high fidelity) application, the audio source signal can be divided into sub-bands. In the simplest case, the audio source signal at whatever frequency it is input can be decomposed into two frequency bands: a base band that contains energy only at frequencies below approximately 2 kHz (f>2 kHz) and a band that contains energy only at frequencies greater than approximately 2 kHz (f>2 kHz). The spatial processing need only be applied to the base band, which makes the processing less expensive than if the entire signal were processed. The main computational expense is in the splitting, and recombining, of the two frequency bands. Perceptual coding schemes, such as MP3, split up the signal into different frequency bands anyway. It is therefore relatively straightforward to combine the perceptual coding with the spatial processing of the lower frequency sub-band as described in a hybrid type of algorithm. Care must be taken to match the delays across the frequency range, though, when the sub-bands are combined to form the final output.

At high sampling rates, the FIR filters necessary for shaping the frequency response of $G_x(z)$ below 2 kHz contain so many coefficients that in most practical applications they are prohibitively expensive to implement. One alternative for cross-talk filter $H_x$ is to use interpolated FIR (IFIR) filters [as described by Saramäki et al., *Design of Computationally Efficient Interpolated FIR Filters*, IEEE Transactions on Circuits and Systems, 35(1), pp. 70–88, January 1988) and Y. Lin and P. P. Vaidyanathan, *An Iterative Approach to the Design of IFIR Matched Filters*, Proc. IEEE International Symposium on Circuits and Systems, pp. 2268–2271, 1997], which are made up of cascades of dense and sparse FIR filters, but even IFIR filters are sometimes too expensive to implement at the sampling frequencies used for high-quality audio. Both FIR and IFIR implementation are suitable for implementation in 16-bit fixed-point precision.

Figure 5:
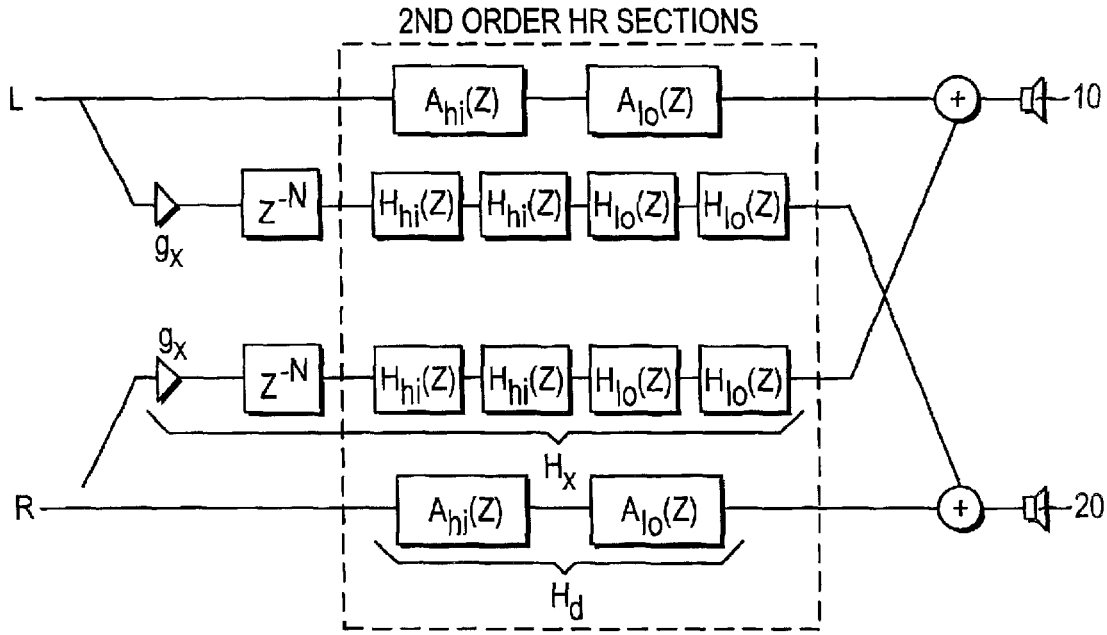
FIG. 5 illustrates an implementation of the stereo widening network according to another embodiment of the invention using cascades of second order infinite impulse response (IIR) filters.

FIG. 5 shows another implementation of the stereo widening algorithm that is particularly suitable for operating at high sampling frequencies, such as the standard sampling rates of 44.1 kHz and 48 kHz commonly used for high-quality audio, because it is more economical and efficient at higher frequencies. (It is believed that the IIR filter implementation is more efficient than the FIR filter implementation even at 10 kHz and above.) The IIR implementation uses cascades of substantially identical second order infinite impulse response (IIR) filters that are applied to each of the cross-talk paths. Each cross-talk filter $H_x$ of FIG. 1 is realized in the implementation of FIG. 5 as a gain $g_x$ followed by a delay of $z^{-N}$ and a cascade of at least four filters in each cross-talk path, including a pair of high-pass filters $H_{hi}(z)$ followed by a pair of low-pass filters $H_{lo}(z)$. A frequency-dependent delay can be implemented by replacing $z^{-N}$ with an allpass filter $A_x$.

$z^{-N}$ is the delay intentionally introduced into the cross-talk path relative to the delay in the direct path. $z^{-N}$ is between approximately 0 and approximately 0.5 ms depending on the spacing between the right and left loudspeakers (shorter delays for narrow spacing between loudspeakers 10, 20, longer delays for wider spacing between loudspeakers 10, 20). The delay $z^{-N}$ is of the order of 10 samples at 48 kHz (which is equivalent to 0.2 ms), and, as with the delay $z^{-(N-Nx)}$ in the embodiment of FIG. 4, $z^{-N}$ also scales up and down linearly with the sampling frequency.

$H_{hi}(z)$ starts cutting on at approximately 250 Hz and $H_{lo}(z)$ starts cutting off at approximately 1.5 kHz. This cascade of filters provides a bandpass filter having a magnitude response as shown in FIG. 3B. The doubling of filters $H_{hi}(z)$and $H_{lo}(z)$ in the cross-talk path (i.e. providing them as pairs) squares the magnitude responses of filters. Consequently, in the pass-band, the magnitude response is still 1 but the doubling of filters causes the roll-off to be steeper.

Rather than implementing $H_x$ in FIG. 5 with four filters, including lowpass filters $H_{lo}(z)$ and highpass filters $H_{hi}(z)$, $H_x$ can be implemented as having only the simple lowpass characteristic of FIG. 2B without the highpass characteristic by using a cascade of two filters only, those filters being the pair of lowpass filters $H_{lo}(z)$ (and omitting the pair of highpass filters $H_{hi}(z)$).

Additionally, in the implementation of FIG. 5, a pair of allpass filters $A_{hi}(z)$ and $A_{lo}(z)$ are inserted into each of the direct paths such that the group delays in each of the direct and cross-talk paths are substantially perfectly matched as a function of frequency to the extent desired (and any desired amount of delay $z^{-N}$ can be controllably and separately inserted into the cross-talk path). The group delay of $A_{hi}(z)$ is designed to be the same as the group delay introduced by $H_{hi}(z)^* H_{hi}(z)$ and the group delay of $A_{lo}(z)$ is designed to be the same as that of $H_{lo}(z)^* H_{lo}(z)$. This can be accomplished using well known filter design principles: the magnitude response of filters B(z), where B(z) is $H_{hi}(z)^* H_{hi}(z)$ or $H_{lo}(z)^* H_{lo}(z)$, is shaped to have double poles, and the corresponding allpass filter A(z), whether $A_{hi}(z)$ or $A_{lo}(z)$, respectively, compensates for the group delay of B(z) with an equivalent group delay by replacing half of the poles of filter B(z) with zeros at their image positions outside the unit circle. B(z) can have zeros, in addition to poles, but the zeros must not be inside the unit circle; otherwise their mirror poles are outside the unit circle, which would make the corresponding filters A(z) unstable. In one implementation, the zeros of filter B(z) are exactly on the unit circle so that their mirror poles fall on top of the zeros, and therefore cancel them out.

As an alternative to the exact matching of the group delays, one can design the filters in the direct paths and the cross-talk paths to achieve the necessary delays by using approximate methods such as group delay equalization and nearly linear phase IIR filters. Careful design using such methods might lead to other efficient and numerically robust implementations based on either FIR or IIR filters, or combinations thereof.

In order to ensure that the effect of the common group delay of direct and cross-talk paths are inaudible, local variations in the group delay between the group delay of the cross-talk path and the direct path as a function of frequency should not exceed approximately 3 ms. This estimate is conservative (so that somewhat larger variations in the group delay may be acceptable), and is a safe range for reproducing most types of audio source material with a relatively high fidelity. The total group delay of the cascade of second order IIR filters shown in FIG. 5, which implements the magnitude response of $G_x$ shown in FIG. 3B, is well within this range of approximately 0 to approximately 3 ms. The cascades of second order IIR filters are sensitive to loss of numerical precision, and are unlikely to perform well in 16-bit fixed-point precision DSP. A 24-bit fixed-point precision, or floating-point, DSP is usually required.

The decision as to whether to choose the implementation of FIG. 4 or FIG. 5 is relatively unimportant if one has a DSP whose sole purpose is to perform spatial processing of audio. The processing efficiency of the IIR filters may be weighed against the lesser complexity of the FIR filter implementation. Ultimately, the implementation chosen will depend on the application.

In summary, the stereo widening system of the present invention is essentially a hybrid of a cross-talk cancellation system and a virtual source imaging system. A cross-talk cancellation system is capable of making one hear sounds close to one's head (like wearing "headphones in a free field") whereas a virtual source imaging system is capable of making one hear sounds that are a certain distance away. This stereo widening system makes some frequencies appear to be close to the head at the side, some frequencies appear to be close to the loudspeakers, but outside the angle spanned by them, and some frequencies come from the speakers themselves. In practice, the combination of the three effects gives the listener a pleasant impression of spatial widening when used on music so that the natural sound of the original recording is preserved regardless of the position of the listener and the properties of the acoustic environment of the loudspeakers, while ensuring that the artifacts of the spatial processing are inaudible.

It should be understood that this invention is generally applicable only for use with loudspeakers, as opposed to other types speakers such as headphones, because there is a natural cross-talk from loudspeakers 10, 20 generated by overlap of sound output from the loudspeakers 10, 20. The cross-talk introduced by filters $H_d$ and $H_x$ is in addition to the cross-talk from loudspeakers 10, 20.

The audio system (or the various filter stages thereof) described above may be arranged in a stand alone system or may be arranged (i.e. included) in a device that has functionality in addition to the playing of an audio signal. One such device is, for example, a digital set-top-box (STB), also known as an IRD, Integrated Receiver Decoder, which receives and decodes digital television signals. The digital television signals are usually transmitted as packets in accordance with the MPEG-2 standard using a digital television broadcast standard, such as Digital Video Broadcasting (DVB) or a similar standard. Some recent set-top boxes have the ability to receive audio/and video information through an Internet connection, realized either through a broadband cable connection or over a digital video broadcast stream. The audio and video signals are usually output from the set-top box to a standard television set. However, they could also be output to any display device, such as a computer monitor or a video projector.

Other examples of devices that may include the described audio system include a Mobile Display Appliance (MDA) (i.e. a portable display product for receiving audio and/or video either over a wireless broadband connection, for instance connected to the Internet, or from a digital video broadcast, or both), a personal digital assistant (PDA), a mobile phone, portable game devices (e.g. Nintendo Game Boy®), other consumer electronic products, etc.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. An audio system for spatially widening a stereophonic sound stage provided by at least two loudspeakers without introducing substantial spectral coloration effects, the system comprising:

a pair of left and right loudspeakers to provide a stereophonic audio output, the left and right loudspeakers being spaced apart from one another; each of said loudspeakers having a single driver;

a left channel audio input for inputting a left channel of an audio signal from an audio source to the left loudspeaker over a first direct signal path;

a right channel audio input for inputting a right channel of an audio signal from the audio source to the right loudspeaker over a second direct signal path;

a first filter stage along the first direct signal path intermediate the left channel audio input and the left loudspeaker for introducing a delay to the left channel of the audio signal before the left channel is output at the left loudspeaker;

a second filter stage along the second direct signal path intermediate the right channel audio input and the right loudspeaker for introducing the delay to the right channel of the audio signal before the right channel is output at the right loudspeaker;

a third filter stage intermediate the left channel audio input and the right loudspeaker along a first indirect signal path for adding a first low frequency cross-talk at frequencies below approximately 2 kHz derived from the left channel audio input to the delayed right channel of the audio signal; and a fourth filter stage intermediate the right channel audio input and the left loudspeaker along a second indirect signal path for adding a second low frequency cross-talk at frequencies below approximately 2 kHz derived from the right channel audio input to the delayed left channel of the audio signal.

2. The audio system of claim 1, wherein the first and second filter stages are substantially identical, and have a first magnitude response; and wherein the third and fourth filter stages are substantially identical and comprise a first element for introducing a gain whose absolute value is smaller than 1.0, a second element for introducing a second delay that is greater than the first delay, and a filter having a second magnitude response that is not greater than the first magnitude response at a frequency below approximately 2 kHz and that is substantially zero at and above approximately 2 kHz.

3. The audio system of claim 2, wherein the absolute value of the gain of the third and fourth filter stages is between approximately 0.5 and 1.0, and wherein the second delay is between approximately 0 ms and approximately 0.5 ms greater than the first delay at frequencies below approximately 2 kHz.

4. The audio system of claim 2, wherein the respective filter in each of the third and fourth filter stages blocks frequencies below approximately 250 Hz.

5. The audio system of claim 1, wherein the delay is a frequency-dependent delay.

6. The audio system of claim 1, wherein the first and second filter stages are substantially identical, and have a first magnitude response; and wherein the third and fourth filter stages are substantially identical, and each comprise a linear phase finite impulse response (FIR) filter having a second magnitude response that is not greater than the first magnitude response at a frequency below approximately 2 kHz and that is substantially zero at and above approximately 2 kHz.

7. The audio system of claim 1, wherein the first and second filter stages are substantially identical, and have a first magnitude response; and wherein the third and fourth filter stages are substantially identical, and each comprise a linear phase interpolated finite impulse response (IFIR) filter having a second magnitude response that is not greater than the first magnitude response at a frequency below approximately 2 kHz and that is substantially zero at and above approximately 2 kHz.

8. The audio system of claim 1, wherein the first and second filter stages are substantially identical, and have a first magnitude response; and wherein the third and fourth filter stages are substantially identical and each further comprises a second element for introducing a second delay that may be greater than the first delay, and a cascade of second order infinite impulse response (IIR) filters, the cascade of filters having a second magnitude response that is not greater than the first magnitude response at a frequency below approximately 2 kHz and that is substantially zero at and above approximately 2 kHz.

9. The audio system of claim 1, wherein the first and second filter stages are substantially identical, and have a first magnitude response; and wherein the third and fourth filter stages are substantially identical and each further comprises a second element for introducing a second delay that is greater than the first delay, and a cascade of infinite impulse response (IIR) filters, finite impulse response (FIR) filters, or a combination thereof, the cascade of filters having a second magnitude response that is not greater than the first magnitude response at a frequency below approximately 2 kHz and that is substantially zero at and above approximately 2 kHz.

10. The audio system of claim 1, wherein the audio system is arranged in a set-top box of a digital television system.

11. The audio system of claim 1, wherein the first, second, third, and fourth filter stages are arranged in a set-top box of a digital television system.

12. The audio system of claim 1, wherein the audio system is arranged in a mobile display appliance.

13. The audio system of claim 1, wherein the first, second, third, and fourth filter stages are arranged in a mobile display appliance.

14. The audio system of claim 1, wherein the audio system is arranged in a consumer electronic product.

15. The audio system of claim 1, wherein the first, second, third, and fourth filter stages are arranged in a consumer electronic product.

16. The audio system of claim 1, wherein the audio system is arranged in a mobile or handheld device, such as a mobile phone, a personal digital assistant, or a game console.

17. The audio system of claim 1, wherein the first, second, third and fourth filter stages are arranged in a mobile or handheld device, such as a mobile phone, a personal digital assistant, or a game console.

18. A method of processing an audio signal for reproduction as stereophonic sound by at least right and left loudspeakers that gives an impression that at least part of the sound emanates from a virtual location spaced apart from the actual location of the loudspeakers without introducing a substantial spectral coloration effect, the method comprising:

inputting an audio signal comprising left and right audio channels to an audio system comprising left and right loudspeakers having a single drive component;

filtering the left audio channel at a first filter stage intermediate a left audio channel input and the left loudspeaker along a first direct signal path between the left audio channel input and the left loudspeaker to delay the left audio channel;

filtering the right audio channel at a second filter stage intermediate a right audio channel input and the right loudspeaker along a second direct signal path between the right audio channel input and the right loudspeaker to delay the right audio channel;

filtering the left audio channel at a third filter stage intermediate the left channel audio input and the right loudspeaker to add a first low frequency cross-talk at frequencies below approximately 2 kHz derived from the left channel audio input to the delayed right channel of the audio signal; and filtering the right audio channel at a fourth filter stage intermediate the right channel audio input and the left loudspeaker to add a second low frequency cross-talk at frequencies below approximately 2 kHz derived from the right channel audio input to the delayed left channel of the audio signal.

19. The method of claim 18, further comprising:

reproducing the delayed right audio channel added to the first low frequency cross-talk at the right loudspeaker; and reproducing the delayed left audio channel added to the second low frequency cross-talk at the left loudspeaker.

20. The method of claim 18, wherein the filtering of the first and second filter stages is performed without introducing any change in a first magnitude response of the left and right audio channels, and wherein the filtering at the third and fourth filter stage delays the first and second low frequency cross-talk with a second delay that is larger than the first delay, introduces a gain whose absolute value is smaller than 1.0, and introduces a second magnitude response that is not greater than the first magnitude response at a frequency below approximately 2 kHz and that is substantially zero at and above approximately 2 kHz.

21. The method of claim 20, wherein the absolute value of the gain of the third and fourth filter stages is between approximately 0.5 and 1.0, and wherein the second delay is between approximately 0 ms and approximately 0.5 ms greater than the first delay at frequencies below approximately 2 kHz.

22. The method of claim 20, wherein the respective filter in each of the third and fourth filter stages blocks frequencies below approximately 250 Hz.

23. The method of claim 18, wherein the third and fourth filter stages each comprise a linear phase finite impulse response (FIR) filter.

24. The method of claim 18, wherein the third and fourth filter stages each comprise a cascade of finite impulse response (IFIR) filters.

25. The method of claim 18, wherein the third and fourth filter stages each comprise a cascade of second order infinite impulse response (IIR) filters.

26. The method of claim 18, wherein the method of processing the audio signal is performed in a consumer electronic product.

* * * * *